US008219398B2

(12) United States Patent
Marple et al.

(10) Patent No.: US 8,219,398 B2
(45) Date of Patent: Jul. 10, 2012

(54) COMPUTERIZED SPEECH SYNTHESIZER FOR SYNTHESIZING SPEECH FROM TEXT

(75) Inventors: Gary Marple, Boxborough, MA (US); Nishant Chandra, Shrewsbury, MA (US)

(73) Assignee: Lessac Technologies, Inc., West Newton, MA (US)

( * ) Notice: Subject to any disclaimer, the term of this patent is extended or adjusted under 35 U.S.C. 154(b) by 1028 days.

(21) Appl. No.: 11/909,514

(22) PCT Filed: Mar. 28, 2006

(86) PCT No.: PCT/US2006/011046

§ 371 (c)(1), (2), (4) Date: Oct. 23, 2007

(87) PCT Pub. No.: WO2006/104988

PCT Pub. Date: Oct. 5, 2006

(65) Prior Publication Data

US 2008/0195391 A1 Aug. 14, 2008

Related U.S. Application Data

(60) Provisional application No. 60/665,821, filed on Mar. 28, 2005.

(51) Int. Cl.
*G10L 13/00* (2006.01)
*G10L 13/08* (2006.01)

(52) U.S. Cl. ..... 704/260; 704/258

(58) Field of Classification Search ..... 704/258, 704/260

See application file for complete search history.

(56) References Cited

U.S. PATENT DOCUMENTS 5,826,232 A * 10/1998 Gulli ..... 704/267
5,890,115 A * 3/1999 Cole ..... 704/258
6,073,100 A * 6/2000 Goodridge, Jr. ..... 704/258
6,810,378 B2 10/2004 Kochanski et al.
6,847,931 B2 1/2005 Addison et al.
6,865,533 B2 3/2005 Addison et al.
6,963,841 B2 11/2005 Handal et al.
7,082,396 B1 * 7/2006 Beutnagel et al. ..... 704/258
7,280,964 B2 10/2007 Wilson et al.
7,693,719 B2 * 4/2010 Chu et al. ..... 704/270.1

(Continued)

OTHER PUBLICATIONS

International Search Report for PCT Patent Application No. PCT/US2006/011046 dated Sep. 1, 2006.

(Continued)

*Primary Examiner* — Douglas Godbold

(74) *Attorney, Agent, or Firm* — K&L Gates LLP

(57) ABSTRACT

Disclosed are novel embodiments of a speech synthesizer and speech synthesis method for generating human-like speech wherein a speech signal can be generated by concatenation from phonemes stored in a phoneme database. Wavelet transforms and interpolation between frames can be employed to effect smooth morphological fusion of adjacent phonemes in the output signal. The phonemes may have one prosody or set of prosody characteristics and one or more alternative prosodies may be created by applying prosody modification parameters to the phonemes from a differential prosody database. Preferred embodiments can provide fast, resource-efficient speech synthesis with an appealing musical or rhythmic output in a desired prosody style such as reportorial or human interest. The invention includes computer-determining a suitable prosody to apply to a portion of the text by reference to the determined semantic meaning of another portion of the text and applying the detennined prosody to the text by modification of the digitized phonemes. In this manner, prosodization can effectively be automated.

20 Claims, 8 Drawing Sheets

U.S. PATENT DOCUMENTS

| | | | | |
|---|---|---|---|---|
| 7,716,052 | B2 * | 5/2010 | Aaron et al. | 704/258 |
| 7,877,259 | B2 | 1/2011 | Marple et al. | |
| 2003/0088418 | A1 * | 5/2003 | Kagoshima et al. | 704/258 |
| 2003/0093278 | A1 * | 5/2003 | Malah | 704/265 |
| 2003/0163316 | A1 * | 8/2003 | Addison et al. | 704/260 |
| 2004/0030555 | A1 * | 2/2004 | van Santen | 704/260 |
| 2004/0054537 | A1 * | 3/2004 | Morio et al. | 704/260 |
| 2004/0111266 | A1 * | 6/2004 | Coorman et al. | 704/260 |
| 2004/0111271 | A1 * | 6/2004 | Tischer | 704/277 |
| 2004/0162719 | A1 | 8/2004 | Bowyer | |
| 2006/0069567 | A1 * | 3/2006 | Tischer et al. | 704/260 |
| 2006/0074672 | A1 * | 4/2006 | Allefs | 704/258 |
| 2007/0260461 | A1 | 11/2007 | Marple et al. | |

OTHER PUBLICATIONS

Preliminary Report on Patentability dated Oct. 11, 2007 for International PCT Patent Application No. PCT/US2006/011046.

* cited by examiner

/N/
/N[1]/
/N[3]n/
/#1/
/#6/
...
Fig. 2
Stressed
Up-glide
Down-glide
Human Interest
Fig. 3
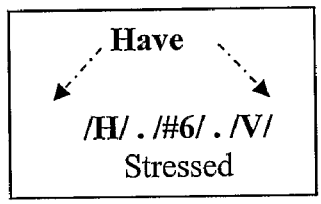
Fig. 4
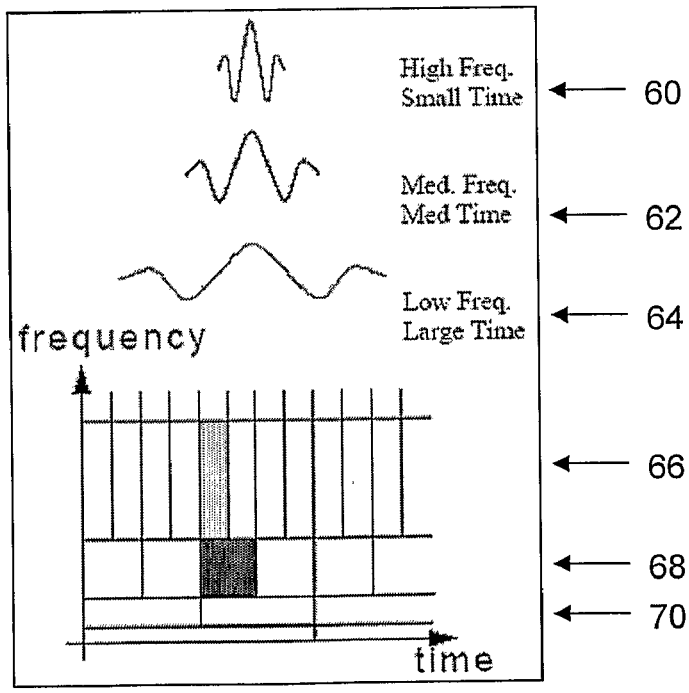
Fig. 8

GRAPHEME-TO-PHONEME MATRIX

| Grapheme | Ï | Î | Á | Á | Pause 1 |
|---|---|---|---|---|---|
| Phoneme | æ- 1 | æ- 2 | æ- 3 | æ- 4 | nil type 1 |
| | | | | | |
| Speaking rate | c-1 | c-1 | c-1 | c-1 | c-1 |
| Pitch initial | P3 | | | | 0 |
| Pitch ending | P4 | | | | 0 |
| Elapsed time | 20 ms | | | | 35 ms |
| Change Profile 1 | 3 | | | | 0 |
| Amplitude initial | 25 | | | | 0 |
| Amplitude ending | 75 | | | | 0 |
| Elapsed time | 140 ms | | | | 35 ms |
| Change profile 1 | 3 | | | | 0 |
| | | | | | |
| | | | | | |
| | | | | | |
| : | | | | | |
| | | | | | |
| | | | | | |
| | | | | | |
| | | | | | |
| | | | | | |

Fig. 7

COMPUTERIZED SPEECH SYNTHESIZER FOR SYNTHESIZING SPEECH FROM TEXT

CROSS-REFERENCE TO A RELATED APPLICATION

The present application claims the benefit of commonly owned U.S. provisional patent application No. 60/665,821 filed Mar. 28, 2005, the entire disclosure of which is herein incorporated by reference thereto.

BACKGROUND OF THE INVENTION

This invention relates to a novel text-to-speech synthesizer, to a speech synthesizing method and to products embodying the speech synthesizer or method, including voice recognition systems. The methods and systems of the invention are suitable for computer implementation, e.g. on personal computers, and other computerized devices, the invention also includes such computerized systems and methods.

Three different kinds of speech synthesizers have been described theoretically, namely articulatory, formant and concatenated speech synthesizers. Formant and concatenated speech synthesizers have been developed for commercial use.

The formant synthesizer was an early, highly mathematical speech synthesizer. The technology of formant synthesis is based on acoustic modeling employing parameters related to a speaker's vocal tract such as the fundament frequency, length and diameter of the vocal tract, air pressure parameters and so on. Formant-based speech synthesis may be fast and low cost, but the sound generated is esthetically unsatisfactory to the human ear. It is usually artificial and robotic or monotonous.

Synthesizing the pronunciation of a single word requires sounds that correspond to the articulation of consonants and vowels so that the word is recognizable. However, individual words have multiple ways of being pronounced, such as formal and informal pronunciations. Many dictionaries provide a guide not only to the meaning of a word, but also to its pronunciation. However, pronouncing each word in a sentence according to a dictionary's phonetic notations for the word results in monotonous speech which is singularly unappealing to the human ear.

To address this problem, prior to the present invention, many commercially available speech synthesizers employed a concatenative speech synthesis method. Basic speech units in the International Phonetic Alphabet (IPA) dictionary for example phonemes, diphones, and triphones, are recorded from an individual's pronunciations and are "concatenated", or chained together to form synthesized speech. While the output concatenative speech quality may be better than that of formative speech, the audible experience in many cases is still unsatisfactory, owing to problems known as "glitches" which may be attributable to imperfect merges between adjacent speech units.

Other significant drawbacks of concatenated synthesizers are requirements for large speech unit databases and high computational power. In some cases, concatenated synthesis employing whole words and sometimes phrases of recorded speech, may make voice identity characteristics clearer. Nevertheless, the speech still suffers from poor prosody when one listens to sentences and paragraphs of "synthesized" speech using the longer prerecorded units. "Prosody" can be understood as involving the pace, rhythmic and tonal aspects of language. It may also be considered as embracing the qualities of properly spoken language that distinguish human speech from traditional concatenated and formant machine speech which is generally monotonous.

Known text-normalizers and text-parsers employed in speech synthesizers are word-by-word and, in the case of concatenated synthesis, sometimes phrase-by-phrase. The individual word approach, even with individual word stress, quickly becomes perceived as robotic. The concatenated approach, while having some improved voice quality, soon becomes repetitious, and glitches may result in misalignments of amplitudes and pitch.

The natural musicality of the human voice may be expressed as prosody in speech, the elements of which include the articulatory rhythm of the speech and changes in pitch and loudness. Traditional formant speech synthesizers cannot yield quality synthesized speech with prosodies relevant to the text to be pronounced and relevant to the listener's reason for listening. Examples of such prosodies are reportorial, persuasive, advocacy, human interest and others.

Natural speech has variations in pitch, rhythm, amplitude, and rate of articulation. The prosodic pattern is associated with surrounding concepts, that is, with prior and future words and sentences. Known speech synthesizers do not satisfactorily take account of these factors. Addison, et al. commonly owned U.S. Pat. Nos. 6,865,533 and 6,847,931 disclose and claim methods and systems employing expressive parsing.

The foregoing description of background art may include insights, discoveries, understandings or disclosures, or associations together of disclosures, that were not known to the relevant art prior to the present invention but which were provided by the invention. Some such contributions of the invention may have been specifically pointed out herein, whereas other such contributions of the invention will be apparent from their context. Merely because a document may have been cited here, no admission is made that the field of the document, which may be quite different from that of the invention, is analogous to the field or fields of the present invention.

BRIEF SUMMARY OF THE INVENTION

There is thus a need for a speech synthesizer and synthesizer method which is resource-efficient and can generate high quality speech from input text. There are further needs for a speech synthesizer and synthesizer method which can provide naturally rhythmic or musical speech and which can readily generate synthetic speech with one or more prosodies.

Accordingly, the invention provides, in one aspect, a novel speech synthesizer for synthesizing speech from text. The speech synthesizer can comprise a text parser to parse text to be synthesized into text elements expressible as phonemes. The synthesizer can also include a phoneme database containing acoustically rendered phonemes useful to express the text elements and a speech synthesis unit to assemble phonemes from the phoneme database and to generate the assembled phonemes as a speech signal. The phonemes selected may correspond with respective ones of the text elements. Desirably, the speech synthesis unit is capable of connecting adjacent phonemes to provide a continuous speech signal.

The speech synthesizer may further comprising a prosodic parser to associate prosody tags with the text elements to provide a desired prosody in the output speech. The prosodic tags indicate a desired pronunciation for the respective text elements.

To enhance the quality of the output, the speech synthesis unit can include a wave generator to generate the speech signal as a wave signal and the speech synthesis unit can effect a smooth morphological fusion of the waveforms of adjacent phonemes to connect the adjacent phonemes.

A music transform may be employed to import musicality into and compress the speech signal without losing the inherent musicality.

In another aspect, the invention provides a method of synthesizing speech from text comprising parsing text to be synthesized into text elements expressible as phonemes and selecting phonemes corresponding with respective ones of the text elements from a phoneme database containing acoustically rendered phonemes useful to express the text elements. The method includes assembling the selected phonemes and connecting adjacent phonemes to generate a continuous speech signal.

In the architecture of one embodiment of speech synthesizer according to the invention, once a parsed matrix of a word is handed to the signal processing unit of the speech synthesizer, the signal is extracted from the phonetic database and its prosody can be changed using a differential prosodic database. All the speech components can then be concatenated to produce the synthesized speech.

Preferred embodiments of the invention can provide fast, resource-efficient speech synthesis with an appealing musical or rhythmic output in a desired prosody style such as reportorial or human interest or the like.

In a further aspect the invention provides a computer-implemented method of synthesizing speech from electronically rendered text. In this aspect, the method comprises parsing the text to determine semantic meanings and generating a speech signal comprising digitized phonemes for expressing the text audibly. The method includes computer-determining an appropriate prosody to apply to a portion of the text by reference to the determined semantic meaning of another portion of the text and applying the determined prosody to the text by modification of the digitized phonemes. In this manner, prosodization can effectively be automated.

Some embodiments of the invention enable the generation of expressive speech synthesis wherein long sequences of words can be pronounced melodically and rhythmically. Such embodiments also provide expressive speech synthesis wherein pitch, amplitude and phoneme duration can be predicted and controlled.

BRIEF DESCRIPTION OF THE SEVERAL VIEWS OF THE DRAWING

Some embodiments of the invention, and of making and using the invention, as well as the best mode contemplated of carrying out the invention, are described in detail below, by way of example, with reference to the accompanying drawings, in which like reference characters designate like elements throughout the several views, and in which:

FIG. 2 is a graphic representation of phonemes in one embodiment of phoneme database useful in a hybrid speech synthesizer according to the invention;

FIG. 3 illustrates some examples of phonetic modifier parameters that can be employed in a differential prosody database useful in the speech synthesizer of the invention;

FIG. 4 illustrates schematically a simplified example of a word with associated phoneme and phonetic modifier parameter information that can be employed in the differential prosody database;

FIG. 7 illustrates one example of a grapheme-to-phoneme matrix useful in the practice of the invention;

FIG. 8 illustrates schematically a wavelet transform method of representing speech signal characteristics which can be employed in the hybrid speech synthesizer and methods of the invention;

DETAILED DESCRIPTION OF THE INVENTION

Figure 1:
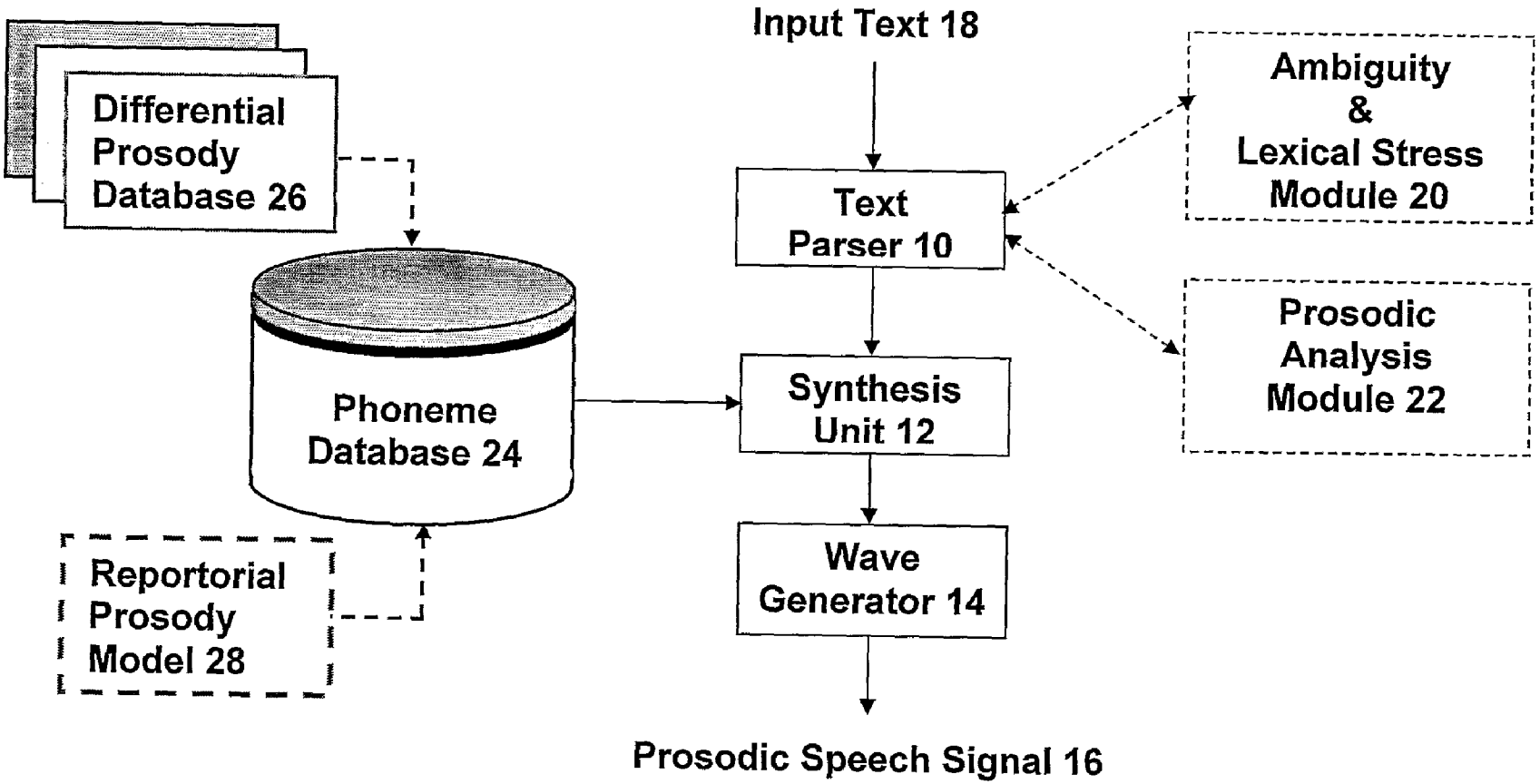
FIG. 1 is a schematic representation of an embodiment of speech synthesizer according to the invention.

Broadly stated, the invention relates to the improvement of synthetic, or "machine" speech to "humanize" it to sound more appealing and natural to the human ear. The invention provides means for a speech synthesizer to be imbued with one or more of a wide range of human speech characteristics to provide high quality output speech that is appealing to hear. To this end, and to help assure the quality of the machine spoken output, some embodiments of the invention can employ human speech inputs and a rules set that embody the teachings of one or more professional speech practitioners.

One useful speech training or coaching method whose principles are helpful in providing a phoneme database useful in practicing the present invention, and in other respects as will be apparent, is described in Arthur Lessac's book, "*The Use And Training Of The Human Voice*", Mayfield Publishing Company, (referenced "Arthur Lessac's book" hereinafter), the disclosure of which is hereby incorporated herein by this specific reference thereto. Other speech training or coaching methods employing rules or speech training principles or practices other than the Lessac methods, can be utilized as will be understood by those of ordinary skill in the art, for example the methods of Kristin Linklater of Columbia University theater division.

The invention provides a novel speech synthesizer having a unique signal processing architecture. The invention also provides a novel speech synthesizer method which can be implemented by a speech synthesizer according to the invention and by other speech synthesizers. In one inventive embodiment, the architecture employs a hybrid concatenated-formant speech synthesizer and a phoneme database. The phoneme database can comprise a suitable number, for example several hundred, of phonemes, or other suitable speech sound elements. The phoneme database can be employed to provide a variety of different prosodies in speech output from the synthesizer by appropriate selection and optionally, modification of the phonemes. Prosodic speech text codes, or prosodic tags, can be employed to indicate or effect desired modifications of the phonemes. Pursuant to a further inventive embodiment, a speech synthesizer method comprises automatically selecting and providing in the output speech an appropriate context-specific prosody.

The text to be spoken can comprise a sequence of text characters, indicative of the words or other utterances to be spoken. As is known in the art, the text characters may comprise a visual rendering of a speech unit, in this case a speech unit to be synthesized. The text characters employed may be well-known alphanumeric characters, characters employed in other languages such as Cyrillic, Hebrew, Arabic, Mandarin Chinese, Sanskrit, katakana characters, or other useful characters. The speech unit may be a word, syllable, diphthong or other small unit and may be rendered in text, an electronic equivalent thereof or in other suitable manner.

The term "prosodic grapheme", or in some cases just "grapheme", as used herein, comprises a text character, or characters, or a symbol representing the text characters, together with an associated speech code, which character, characters or symbol and speech code may be treated as a unit. In one embodiment of the invention, each prosodic grapheme, or grapheme is uniquely associated with a single phoneme in the phoneme database. The unit represents a specific phoneme. The speech code contains a prosodic speech text code, a prosodic tag, or other graphical notation that can be employed to indicate how the sound corresponding to the text element that is to be output by the synthesizer as a speech sound.

The prosodic tag includes additional information regarding modification of acoustical data to control the sound of the synthesized speech. The speech code serves as a vector by which a desired prosody is introduced into the synthesized speech. Similarly, each acoustic unit, or corresponding electronic unit, that is represented by a prosodic grapheme, is described herein as a "phoneme." Thus, prosodic instruction can be provided in the speech code and the variables to be controlled can be indicated in the prosodic tag or other graphical notation.

Speech synthesizer. Pursuant to the invention, a hybrid speech synthesizer can comprise a text parser, a phoneme database and a speech synthesis unit to assemble or concatenate phonemes selected from the database, in accordance with the output from the text parser, and generate a speech signal from the assembled phonemes. Desirably, although not necessarily, the speech synthesizer also includes a prosodic parser. The speech signal can be stored, distributed or audibilized by playing it through suitable equipment.

The synthesizer can comprise a computational text processing component which provides text parsing and prosodic parsing functionality from respective text parser and prosodic parser subcomponents. The text parser can identify text elements that can be individually expressed, for example, audibilized with a specific phoneme in the phoneme database. The prosodic parser can associate prosody tags with the text elements so that the text elements can be rendered with a proper or desired pronunciation in the output synthetic speech. In this way a desired prosody or prosodies can be provided in the output speech signal that is or are appropriate for the text and possibly, to the intended use of the text.

In one embodiment of the inventive hybrid formant-concatenative speech synthesizer, the phonemes employed in the basic phoneme set are speech units which are intermediate in size between the typically very small time slices employed in a formant engine and the rather larger speech units typically employed in a concatenative speech engine, which may be whole mono- or polysyllabic words, phrases or even sentences.

The speech synthesizer may further comprise an acoustic library of one or more phoneme databases from which suitable phonemes to express the graphemes can be selected. The prosodic markings, or codes can be used to indicate how the phonemes are to be modified for emphasis, pitch, amplitude, duration and rhythm, or any desired combination of these parameters, to synthesize the pronunciation of text with a desired prosody. The speech synthesizer may effect appropriate modifications in accordance with the prosodic markings to provide one or more alternative prosodies.

In another embodiment, the invention provides a differential prosody database comprising multiple parameters to change the prosodies of individual phonemes to enable synthesized spoken text to be output with different prosodies. Alternatively, a database of similar phonemes with different prosodies or different sets of phonemes, each set being useful for providing a different prosody style, can be provided, if desired.

Referring to FIG. 1, the embodiment of speech synthesizer shown utilizes a text parser 10, a speech synthesis unit 12 and a wave generator 14 to generate a prosodic speech signal 16 from input text 18. Embodiments of the invention can yield a prosodic speech signal 16 with identifiable voice style, expressiveness, and added meaning attributable to the prosodic characteristics.

Text parser 10 can optionally employ an ambiguity and lexical stress module 20 to resolve issues such as "Dr. Smith" versus "Smith Dr." and to provide proper syllabication within a word. Additional prosodic text analysis components, for example, module 22, can be used to specify rhythm, intonation and style.

A phoneme database 26 can be accessed by speech synthesis unit 24 and in turn has access to a differential prosody database 26. The phonemes in phoneme database 26 have parameters for a basic prosody model such as reportorial prosody model 28. Other prosody models, for example human interest, can be input from differential prosody database 26.

Synthesis unit 12 matches or corresponds suitable phonemes from phoneme database 24 with respective text elements as indicated in the output from text parser 10 assembles the phonemes and outputs the signal to wave generator 14. Wave generator 14 employs wavelet transforms, or another suitable technique, and morphological fusion to output prosodic speech signal 16 as a high quality continuous speech waveform. Some useful embodiments of the invention employ pitch synchronism to promote smooth fusion of one phoneme to the next. To this end, where adjacent phonemes have significantly different pitches, one or more wavelets can be generated to transition from the pitch level and wave form of one phoneme to the pitch level and wave form of the next.

The speech synthesizer can generate an encoded signal comprising a grapheme matrix containing multiple graphemes along with the normalized text, prosodic markings or tags, timing information and other relevant parameters, or a suitable selection of the foregoing parameters, for the individual graphemes. The grapheme matrix can be handed off to a signal processing component of the speech synthesizer as an encoded phonetic signal. The encoded phonetic signal can provide phonetic input specifications to a signal-processing component of the speech synthesizer.

Wave generator 14 can, if desired, employ a music transform, such as is further described with reference to FIG. 14 to uncompress the speech signal with its inherent musicality and generate the output speech signal. Suitable adaptations of music transforms employed in music synthesizers may for example be employed.

The signal processor can employ the encoded phonetic signal to generate a speech signal which can be played by any suitable audio system or device, for example a speaker or headphone, or may be stored on suitable media to be played later. Alternatively, the speech signal may be transmitted across the internet, or other network to a cell phone or other suitable device.

If desired, the speech signal can be generated as a digital audio waveform which may, optionally, be in wave file format. In a further novel aspect of the invention, conversion of the encoded phonetic signal to a waveform may employ wavelet transformation techniques. In another novel aspect, smooth connection of one phoneme to another can be effected by a method of morphological fusion. These methods are further described below.

Phoneme Database. One embodiment of a phoneme database useful in the practice of the invention comprises a single-prosodic, encoded recording of each of a number of acoustic units constituting phonemes. The encoded recordings may comprise a basic phoneme set having a basic prosody. The single prosody employed for the recordings may be a "neutral" prosody, for example reportorial, or other desired prosody, depending upon the speech synthesizer application. The phoneme set may be assembled, or constituted, to serve a specific purpose, for example to provide a full range of a spoken language, of a language dialect, or of a language subset suitable to a specific purpose, for example an audio book, paper, theatrical work or other document, or customer support.

Desirably, the basic phoneme set may comprise a number of phonemes which is significantly larger than the number of 53 which is sometimes regarded as the number of phonemes in standard American English. The number of phonemes in the basic set can for example be in the range of from about 80 to about 1,000. Useful embodiments of the invention can employ a number of phonemes in the range of about 100 to about 400, for example from about 150 to 250 phonemes. It will be understood that the phoneme database may comprise other numbers of phonemes, according to its purpose, for example a number in the range of from about 20 to about 5,000.

Suitable additional phonemes can be provided pursuant to the speech training rules of the Lessac system or another recognized speech training system, or for other purposes. An example of an additional phoneme is the "t-n" consonant sound when the phrase "not now" is pronounced according to the Lessac prepare-and-link rule which calls for the "t" to be prepared but not fully articulated. Other suitable phonemes are described in Arthur Lessac's book or will be known or apparent to those skilled in the art.

In one embodiment of the invention, suitable graphemes for a reportorial prosody may directly correspond to the basic phonetic database phonemes and the prosody parameter values can represent default values. Suitable default values can be derived, for example, from the analysis of acoustic speech recordings for the basic prosody, or in other appropriate manner. Default duration values can be defined from the basic prosody speech cadence, and intonation pattern values can be derived directly from the syntactic parse, with word amplitude stress only, based on preceding and following word amplitudes.

An example of a phoneme database useful in the practice of the invention is described in more detail below with reference to FIG. 2. Referring to FIG. 2, each symbol shown indicates a specific phoneme in the phoneme database. Four exemplary symbols are shown. The symbols employ a notation disclosed in international PCT publication number WO 2005/088606 of applicant herein. The disclosure of WO 2005/088606 is incorporated by reference herein. For example, the code "N1" may be used to represent the sound of a neutral vowel "u", "o", "oo" or "ou" as properly pronounced in the respective word "full", "wolves", "good", "could" or "coupon". And the code "N1" may be used to represent the sound of a neutral diphthong "air", "are", "ear" or "ere" as properly pronounced in words such as "fair", "hairy", "lair", "pair", "wearing" or "where". Usefully, the phonetic database can store encoded speech files for all the phonemes of a desired phoneme set.

The invention includes embodiments wherein the phoneme database comprises compound phonemes comprising a small number of fused phonemes. Fusing may be morphological fusing as described herein or simple electronic or logical linking. The small number of phonemes in a compound phoneme may be for example from 2 to 4 or even about 6 phonemes. In some embodiments of the invention, the phonemes in the phoneme database are all single rather than compound phonemes. In other embodiments, at least 50 percent of the phonemes in the phoneme database are single phonemes rather than compound phonemes.

It will be understood that the speech synthesizer may assemble phonemes with larger speech recordings, if desired, for example words, phrases, sentences or longer spoken passages, depending upon the application. It is envisaged that where free-form or system-unknown text is to be synthesized, at least 50 percent of the generated speech signal will be assembled from phonemes as described herein.

Differential Prosody Database. The invention also provides an embodiment of speech synthesizer wherein the utility of the basic phoneme set is expanded by modifying the spectral content of the voice signals in different ways to create speech signals with different prosodies. The differential prosody database may comprise one or more differential prosody models which when applied to the basic phoneme set, or another suitable phoneme set provide a new or alternative prosody. Providing multiple or different prosodies from a limited phoneme set can help limit the database and or computational requirements of the speech synthesizer.

Multiple prosodies of the phoneme can be generated by modifying the signals in the phonetic database. This modification can be done by providing multiple suitable phonetic modification parameters in the differential prosody database which the speech synthesizer can access to change the prosody of each phoneme as required. Phonetic modification parameters such as are employed for signal generation in formant synthesis may be suitable for this purpose. These may include parameters for modification of pitch, duration and amplitude, and any other desired appropriate parameters. Unlike the parameters used in formant synthesis for signal generation, the prosodic modification parameters employed in practicing this aspect of the present invention are selected and adapted to provide a desired prosodic modification.

The phoneme modifier parameters can be stored in the differential phoneme database, in mathematical or other suitable form and may be employed to differentiate between a given simple or basic phoneme and a prosodic version or versions of the phoneme.

Sufficient sets of phonetic modification parameters can be provided in the differential prosody database to provide a desired range of prosody options. For example, a different set of phonetic modification parameters can be provided for each prosody style it is desired to use the synthesizer to express. Each set corresponding with a particular prosody can have phonetic modification parameters for all the basic phonemes, or for a subset of the basic phonemes, as is appropriate. Some examples of prosody styles for each of which a set of phonetic modification parameters can be provided in the database include, conversational, human interest, advocacy, and others as will be apparent to those skilled in the art. Phonetic modification parameters may be included for a reportorial prosody if this is not the basic prosody.

Some examples of additional prosody styles include human interest, persuasive, happy, sad, adversarial, angry, excited, intimate, rousing, imperious, calm and meek. Many other prosody styles can be employed as will be known or can become known to those skilled in the art.

A variety of differential prosody databases, or a differential database for applying a variety of different prosodies, can be created by having the same speaker record the same sentences with a different prosodic mark-up for a number of alternative prosodies plus a default prosody, for example reportorial. In one embodiment of the invention, differential databases are created for two to seven additional prosodies are created. More prosodies can of course be accommodated within a single product, if desired.

The invention includes embodiments wherein suitable coefficients to transform the default prosody values in the database to alternative prosody values are determined by mathematical calculation. In such embodiments, the prosody coefficients can be stored in a fast run-time database. This method avoids having to store and manipulate computationally complex and storage-hungry wave data files representing the actual pronunciations, as may be necessary with known concatenated databases.

In one illustrative example of this aspect of the invention, a comprehensive default database of 300-800 phonemes of various pitches, durations, and amplitudes is created from the recordings of about 10,000 sentences spoken by trained Lessac speakers. These phonemes are modified with differential prosody parameters, as described herein, to enable a speech synthesizer in accordance with the invention to pronounce unrecorded words that have not been "spoken in" to the system. In this way, a library of fifty or one hundred thousand words or more can be created and added to the default database with only a small storage footprint.

Employing such techniques, or their equivalent, some methods of the invention enable a speech synthesizer to be provided on a hand-held computerized device such for example as an iPod® (trademark, Apple Computer Inc.) device, a personal digital assistant or a MP3 player. Such a hand-held speech synthesizer device may have a large dictionary and multiple-voice capability. New content, documents or other audio publications, complete with their own prosodic profiles can be obtained by downloading encrypted differential modification data provided by the grapheme-to-phoneme matrices described herein, an example of which is illustrated in FIG. 7 and further described below, avoiding downloading bulky wave files or the like. The grapheme-to-phoneme matrix can be embodied as a simple resource efficient data file or data record so that downloading and manipulating a stream of such matrices defining an audio content product is resource efficient.

By employing run-time versions of the text-to-speech engine efficient, compact products can be provided which can run on handheld personal computing devices such as personal digital assistants. Some embodiments of such engines and synthesizers are expected to be small compared with conventional concatenated text-to-speech engines and will easily run on hand held computers such as Microsoft based PDA's.

Referring to FIG. 3, the exemplary phoneme modifiers shown may comprise individual emphasis parameters, for example an instruction that the respective phoneme is to be stressed. If desired a degree of stressing (not shown) may also be specified, for example "light", "moderate" or "heavy" stress. Other possible parameters include, as illustrated, an upglide and a downglide to indicate ascending and descending pitch. Alternatively, a "global" parameter such as "human interest" may be employed to indicate a style or pattern of emphasis parameters that is to be applied to a portion of a text or the complete text. These and other prosodic modifiers that may be employed, are further described in WO 2005/088606. Still others will be, or will become, apparent to those skilled in the art.

As shown in FIG. 4, the illustrative word "have" has been parsed into the three phonemes "H", "#6" and "V" using a speech code notation such as is disclosed in WO 2005/088606. These three phonemes, logically separated by a period, ".", indicate the three sound components required for proper pronunciation of the word "have" with a neutral or basic prosody such as reportorial. The prosodic modifier parameter "stressed" is associated with phoneme #6. For simplicity, other phoneme modifier parameters that may usefully be employed, for example pitch and timing information, are not illustrated. To synthesize the word "have" the signals corresponding to each of the three phonemes are fletched from the phoneme database and the prosody of #6 is changed to "Stressed" according to the parameters stored in the differential phoneme database. Finally, a synthesized spoken rendering of the word is generated by appropriate fusion of the phonemes /H/, /#6/stressed, and /V/, into a coherent synthesized utterance in a suitable manner, for example by morphological phoneme fusion as is described below.

Text Parser. The text parser can comprise a text normalizer, a semantic parser to elucidate the meaning, or other useful characteristics of the text, and a syntactic parser to analyze the sentence structure. The semantic parser can include part-of-speech ("POS") tagging and may access dictionary and/or thesaurus databases if desired. The semantic parser can also include syntactic sentence analysis and logical diagramming, if desired as well as part-of-speech tagging if this function has not been adequately rendered by the semantic parser. Buffering may be employed to extend the range of text comprehended by the text parser beyond the immediate text being processed.

If desired, the buffering may comprise forward or backward buffering or both forward and backward buffering so that portions of the text adjacent a currently processed portion can be parsed and the meaning or other character of those adjacent portions may also be determined. This can be useful to enable ambiguities in the meaning of the current text to be resolved and can be helpful in determining a suitable prosody for the current text, as is further described below.

In one embodiment, the text normalizer can be used to identify abnormal words or word forms, names, abbreviations, and the like, and present them as text words to be synthesized as speech, as is per se known in the art. The text normalizer can resolve ambiguities, for example, whether "Dr." is "doctor" or "drive", using part-of-speech ("POS") tagging as is also known in the art.

To prepare the text being processed for prosodic markups, each parsed sentence can be analyzed syntactically and presented with appropriate semantic tags to be used for prosodic assignment. For example, the sentence:

"John drove to Cambridge yesterday."

considered alone can be treated as a simple declarative sentence. In the context of multiple sentences, however, the sentence may be the answer to any one of several questions. The text parser can employ forward buffering to enable a determination to be made as to whether a question is being asked and, if so, what answer is represented by the text. Based upon this determination, a selection can be made as to which phoneme or phonemes should receive what emphasis or other prosodic parameters to create a desired prosody in the output speech. For example, the question "Who drove to Cambridge yesterday?" would receive prosodic emphasis on "John" as the answer to the question "who?," while the question of "Where did John go yesterday?" would receive prosodic emphasis on "Cambridge" as the answer to the question "where?."

Prosodic Parsing.

By employing known normalization and syntactic parsing techniques with the novel adaptation of forward buffering plus additional text analysis, the invention can provide syntactically parsed sentence diagrams with prosodic phrasing based on semantic analysis to provide text markups relating to specifically identified prosodies.

A sentence that has been syntactically analyzed and diagrammed or otherwise marked can be employed as a unit to which the basic prosody is applied. If the basic prosody is reportorial, the corresponding output synthetic speech should be conversationally neutral to a listener. The reportorial output should be appropriate for a speaker who does not personally know the listener, or is speaking in a mode of one speaker to many listeners. It should be that of a speaker who wants to communicate clearly and without a point of view.

To express a desired prosody, text to be synthesized can be represented by graphemes including markings indicating appropriate acoustic requirements for the output speech. Desirably, the requirements and associated markings are related to a speech training system, whereby the machine synthesizer can emulate high quality speech. For example, these requirements may include phonetic articulation rules, the musical playability of a text element, the intonation pattern or the rhythm or cadence, or any two or more of the foregoing. Reference is made to characteristics of the Lessac voice system, with the understanding that different characteristics may be employed for other speech training systems. The markings may correspond directly to an acoustic unit in phonetic database.

The phonetic articulation rules may include rules regarding co-articulations such as Lessac direct link, play-and-link and prepare-and-link and where in the text they are to be applied. Musical playability may include an indication that a consonant or vowel is musically "playable" and how it is playable, for example as a percussive instrument, such as a drum, or a more drawn-out, tonal instrument, such as a violin or horn, with pitch and amplitude change. A desired intonation pattern can be indicated by marking or tagging for changes in pitch and amplitude. Rhythm and cadence, can be set in the basic prosody at default values for reportorial or conversational speech, depending upon the prosody style selected as basic or default.

Musically "playable" elements may require variation of pitch, amplitude, cadence, rhythm or other parameters. Each parameter also has a duration value, for example pitch change per unit of time for a specified duration. Each marking that corresponds to an acoustic unit in the phonetic database, also can be tagged as to whether it is playable in a particular prosody, and, if not, the tag value can be set at a value of 1, relative to the value in the basic prosody database.

Analysis of an acoustic database of correctly pronounced text with a specified prosody, for example as pronounced or generated pursuant to the Lessac system, can be used to derive suitable values for pitch, amplitude, cadence/rhythm and duration variables for the prosody to be synthesized.

Parameters for alternative prosodies can be determined by using a database of recorded pronunciations of specific texts that accurately follow the prosodic mark-ups indicating how the pronunciations are to be spoken. The phonetic database for the prosody can be used to derive differential database values for the alternative prosody.

Pursuant to the invention, if desired the prosodies can be changed dynamically, or on the fly, to be appropriate to the linguistic input.

Figure 5:
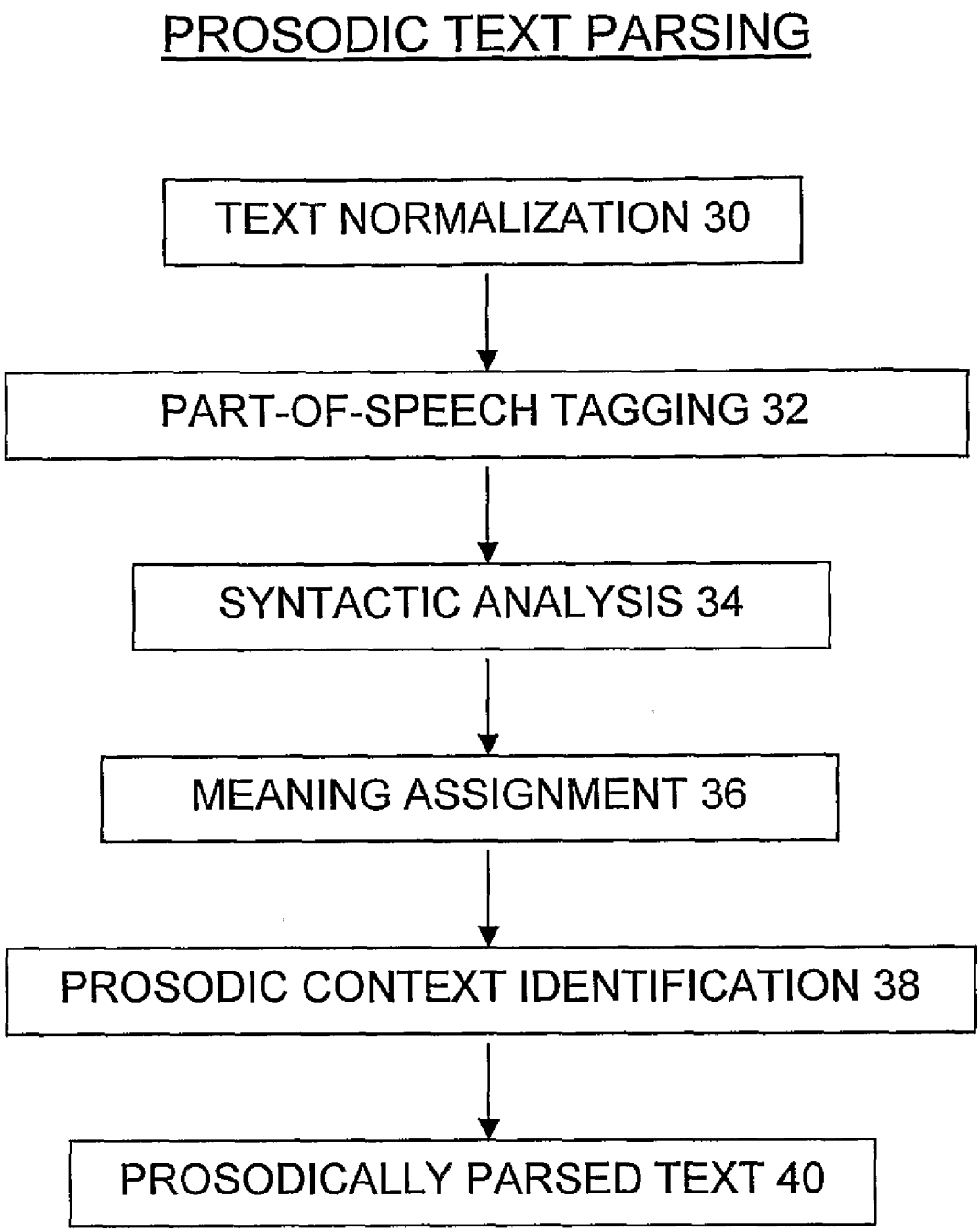
FIG. 5 is a block flow diagram of a prosodic text parsing method useful in the practice of the invention.

Referring to FIG. 5, the embodiment of prosodic text parsing method shown can be used to instruct the speech synthesizer to produce sounds that imitate human speech prosodies. The method begins with a text normalization step 30 wherein a phrase, sentence, paragraph or the like of text to be synthesized is normalized. Normalization can be effected employing a known text parser, a sequence of existing text parsers, or a customized text normalizer adapted to the purposes of the invention, in an automatically applied parsing procedure. Some examples of normalization in the normalized text output include: disambiguation of "Dr." to "Doctor" rather than "Drive"; expressing "2" text "two,"; rendering "$5" as "five dollars" and so on, many suitable normalizations being known in the art. Others can be devised.

The normalized text output from step 30 can be subject to part-of-speech tagging, step 32. Part-of-speech tagging 32 can comprise syntactically analyzing each sentence of the text into a hierarchical structure in manner known per se, for example to identify subject, verb, clauses and so on.

In the next step, meaning assignment, step 36, a commonly used meaning for each word in the part-of-speech tagged text is presented as reference. If desired, meaning assignment 36 can employ an electronic version of a text dictionary, optionally with an electronic thesaurus for synonyms, antonyms, and the like, and optionally also a homonym listing of words spelled differently but sounding the same.

Following and in conjunction with meaning assignment 36, forward or backward buffering, or both, can be employed for prosodic context identification, step 38, of the object phrase, sentence, paragraph or the like. The forward or backward buffering technique employed, can, for example, be comparable with techniques employed in natural language processing as a context for improving the probability of candidate words when attempting to identify text from speech, or when attempting to "correct" for misspelled or missing words in a text corpus. Buffering may usefully retain prior or following context words, for example subjects, synonyms, and the like.

In this way, various useful analyses can be performed. For example, when and where it is appropriate to use different speakers' voices may be identified. A sentence that appears in isolation, to be a simple declarative sentence may be identified as the answer to a prior question. Alternatively, additional information on a previously initiated subject, may be revealed. Other examples will be known or apparent.

In this manner, prosodically parsed text 40 may be generated as the product of prosodic context identification, step 38. Prosodically parsed text 40 can be further processed to provide prosodically marked up text by methods such as those illustrated in FIG. 6.

Figure 6:
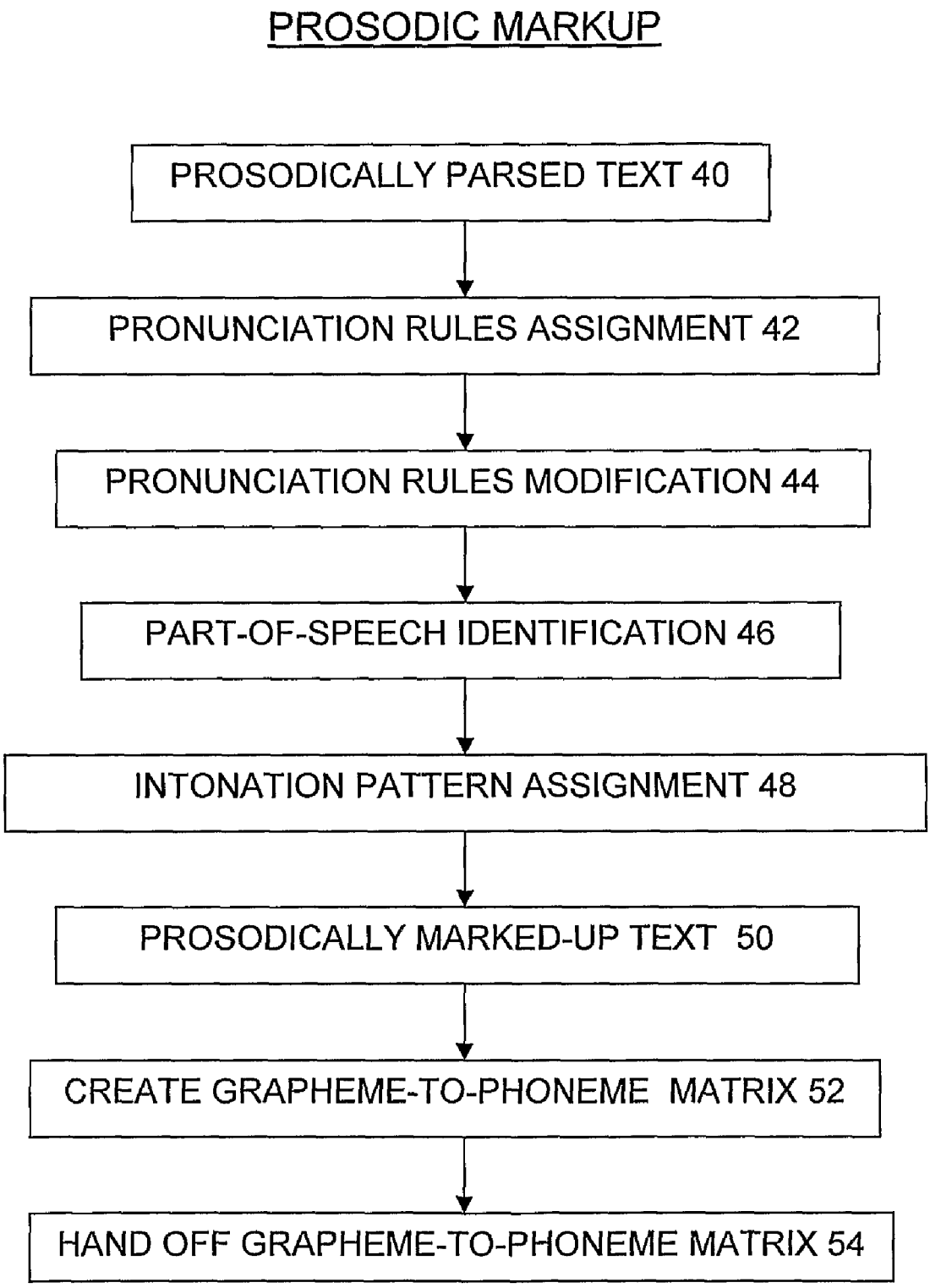
FIG. 6 is a block flow diagram of a prosodic markup method useful in the practice of the invention.

Referring to FIG. 6, one example of processing to assign prosodic markings to prosodically parsed text 40 can be effected by employing computational linguistics techniques will now be described. In this method mark-up values or tags, for features such as playable consonants, sustainable playable consonants, and intonations for playable vowels and so on can be assigned. The various steps may be performed in the sequence described or another suitable sequence as will be apparent to those skilled in the art.

In an initial pronunciation rules assignment step, step 42, each sentence can be parsed into an array, beginning with the text sequence of words and letters and assigning pronunciation rules to the letters comprising the words. The letter sequences across word boundaries can then be examined to identify pronunciation rules modification, step 44, for words in sequence based on rules about how the preceding word affects the pronunciation of the following word and vice-versa.

In a part-of-speech identification step, step 46, the part-of-speech of each word in the sentence is identified, for example from the tagging applied in part-of-speech tagging step 32 and a hierarchical sentence diagram constructed if not already available.

In an intonation pattern assignment step, step 48, an intonation pattern of pitch change and words to be stressed, which is appropriate for the desired prosody, is assigned, creating prosodically marked up text 50. Prosodically marked up text 50 can then be output to create a grapheme-to-phoneme matrix, step 52, such as that shown in FIG. 7.

Reference will now be made to the grapheme-to-phoneme hand-off matrix shown in FIG. 7, and especially to the first column for which some exemplary data is provided, and which relates to the phoneme Ï, identified in the first row of the table. Set forth in the rows below the phoneme identifier is the prosodic tag information relating to the grapheme which may comprise any desired combination of parameters that will be effective as may be understood from this disclosure.

Referring to the first data column in FIG. 7, and commencing at the top of the column, the symbol "Ï" is an arbitrary symbol identifying the grapheme, while the symbol "æ-1" is another arbitrary symbol identifying the phoneme which is uniquely associated with grapheme "Ï". Various parameters which describe phoneme æ-1 and which can be varied or modified to modulate the phoneme are set forth in the column beneath the symbols.

In the next row, a speaking rate code "c-1" is shown. This may be used to indicate a conversational rate of speaking. An agitated prosody could code for a faster speaking rate and a seductive prosody could code for a slower speaking rate. Other suitable speaking rates and coding schemes for implementing them will be apparent to those skilled in the art.

The next two data items down the column, P3 and P4 denote initial and ending pitches for pronunciation of the phoneme æ-1 on an arbitrary pitch scale. These are followed by a duration 20 ms and a change profile which is an acoustic profile describing how the pitch changes with time, again on an arbitrary scale, for example, upwardly downwardly, with a circumflex or a summit. Other useful profiles will be apparent to those skilled in the art.

The final four data items, 25, 75, 140 ms and 3 denote similar parameters for amplitude to those employed for pitch to describe the magnitude, duration and profile of the amplitude.

Various appropriate values can be tabulated across the rows of the table for each grapheme indicated at the head of the table, of which only a few are shown. The righthand column of FIG. 7 lists parameters for a "grapheme" comprising a pause, designated as a "type 1" pause. These parameters are believed to be self-explanatory. Other pauses may be defined.

It will be understood that the hand-off matrix can comprise any desired number of columns and rows according to system capabilities and the number of elements of information, or instructions it is desired to provide for each phoneme.

Such a grapheme-to-phoneme matrix provides a complete toolkit for changing the sound of a phoneme pursuant to any desired prosody or other requirement. Pitch, amplitude and duration throughout the playing of a phoneme may be controlled and manipulated. When utilized with wavelet and music transforms to give character and richness to the sounds generated, a powerful, flexible and efficient set of building blocks for speech synthesis is provided.

The grapheme matrix includes the prosodic tags and may comprise a prosodic instruction set indicating the phonemes to be used and their modification parameters, if any to express the respective text elements in the input. Referring to FIG. 7, the change profile is the difference between the initial pitch or amplitude and their ending values with the changes expressed as an amount per unit of time. The pitch change may approximate a circumflex, or another desired profile of change. The base prosody values can be derived from acoustic database information as described herein.

The grapheme matrix can be handed off to the speech synthesizer, step 54.

To provide speech which can be pleasantly audibilized by a loudspeaker, headphone or other audio output device, it may be desirable to convert or transform a digital phonetic speech signal, generated as described herein, to an analog wave signal speech output. Desirably the wave signal should be free of discontinuities and should smoothly progress from one phoneme to the next.

Conventionally, Fourier transform methods have been used in formant synthesis to transform digital speech signals to the analog domain. While Fourier transforms, Gabor expansions or other conventional methods can be employed in practicing the invention, if desired, it would also be desirable to have a digital-to-analog transformation method which places reduced or modest demand on processing resources and which provides a rich and pleasing analog output with good continuity from the digital input.

Toward this end, a speech synthesizer according to the present invention can employ a wavelet transform method, one embodiment of which is illustrated in FIG. 8, to generate an analog waveform speech signal from a digital phonetic input signal. The input signal can comprise selected phonemes corresponding with a word, phrase, sentence, text document, or other textual input. The signal phonemes may have been modified to provide a desired prosody in the output speech signal, as is described herein. In the illustrated embodiment of wavelet transform method, a given frame of the input signal is represented in terms of wavelet time-frequency tiles which have variable dimensions according to the wavelet sampled. Each wavelet tile has a frequency-related dimension and a transverse or orthogonal time-related dimension. Desirably, the magnitude of each dimension of the wavelet tile is determined by the respective frequency or duration of the signal sample. Thus, the size and shape of the wavelet tile can conveniently and efficiently represent the speech characteristics of a given signal frame.

A benefit provided by some embodiments of the invention is the introduction of greater human-like musicality or rhythm into synthesized speech. In general, it is known that musical signals, especially human vocal signals, for example singing, require sophisticated time-frequency techniques for their accurate representation. In a nonlimiting, hypothetical case, each element of a representation captures a distinct feature of the signal and can be given either a perceptual or an objective meaning.

Figure 9:
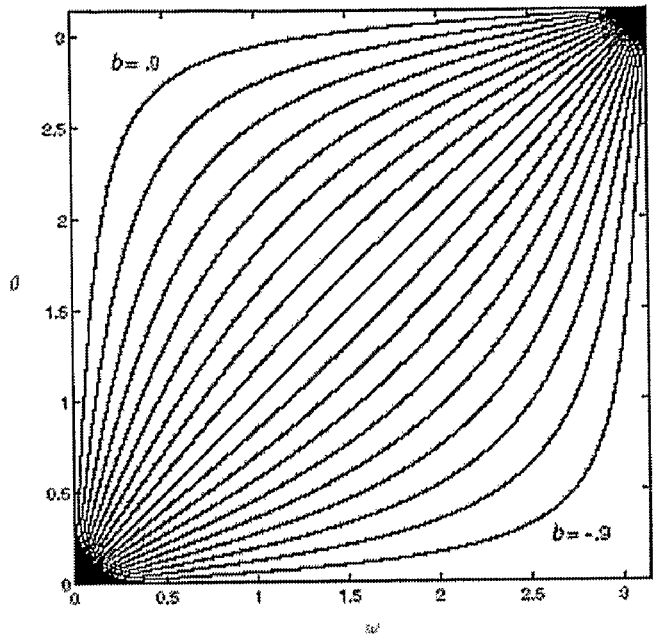
FIG. 9 illustrates a family of wrapping curves that can be employed in the wavelet transform illustrated in FIG. 8.

Useful embodiments of the present invention may include extending the definition of a wavelet transform in a number of directions, enabling the design of bases with arbitrary frequency resolution to avoid solutions with extreme values outside the frequency wrappings shown in FIG. 9. Such embodiments may also or alternatively include adaptation to time-varying pitch characteristics in signals with harmonic and inharmonic frequency structures. Further useful embodiment of the present invention include methods of designing the music transform to provide acoustical mathematical models of human speech and music.

The invention furthermore provides embodiments comprising a wavelet transform method which is beneficial in speech synthesis and which may also usefully applied to musical signal analysis and synthesis. In these embodiments, the invention provides flexible wavelet transforms by employing frequency warping techniques, as will be further explained below.

Referring to FIG. 8, in the upper portion of the figure, a high frequency wave sample or wavelet 60, a medium frequency wavelet 62 and a low frequency wavelet 64 are shown. As labeled, where, again, frequency is plotted on the y-axis against time on the x-axis. The lower portion of FIG. 8 shows wavelet time-frequency tiles 66-70 corresponding with respective ones of wavelets 60-64. Wavelet 60 has a higher frequency and shorter duration and is represented by tile 66 which is an upright rectangular block. Wavelet 62 has a medium frequency and medium duration and is represented by tile 68 which is a square block. Wavelet 64 has a lower frequency and longer duration and is represented by tile 70 which is a horizontal rectangular block.

In the embodiment of wavelet transform method illustrated in FIG. 8, the frequency range of the desired speech output signal is divided into three zones, namely high, medium and low frequency zones. The described use of time-frequency representation with rectangular tiles can be helpful in addressing the phenomenon wherein lower frequency sounds require a longer duration to be clearly identified than do higher frequency sounds. Thus the rectangular blocks or tiles used to represent the higher frequencies can extend vertically to represent a larger number of frequencies with a short duration. In contrast, the lower frequency blocks or tiles have an extended time duration and embrace a small number of frequencies. The medium frequencies are represented in an intermediate manner.

A music transform with suitable parameters, can be used for generation of a frequency-wrapped signal to provide a family of wrapping curves such as is shown in FIG. 10, where, again, frequency is plotted on the y-axis against time on the x-axis.

Figure 10:
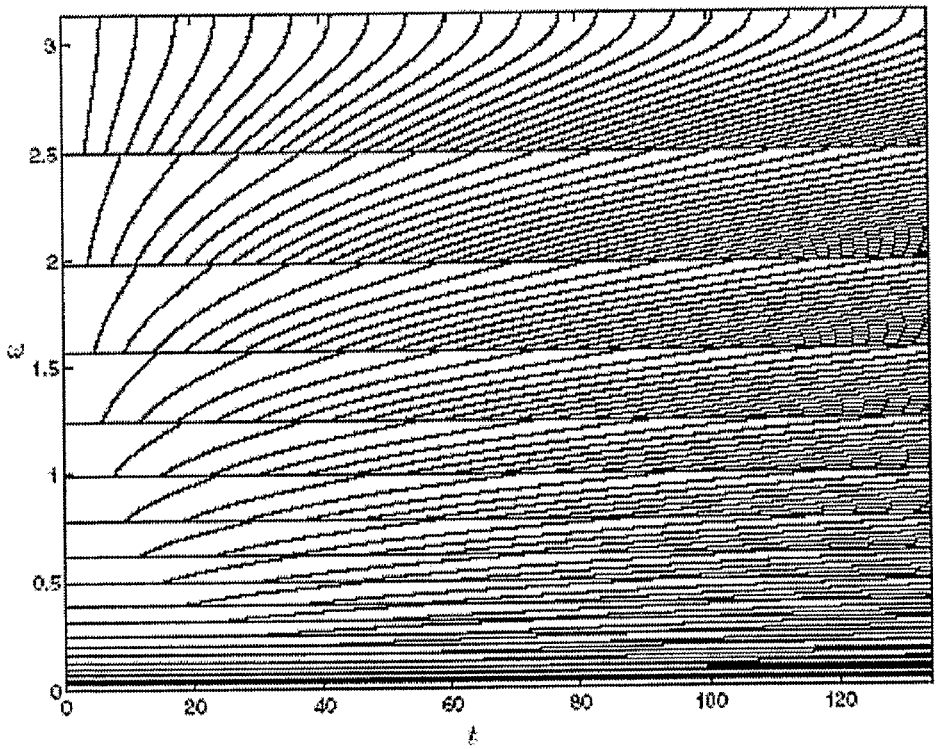
FIG. 10 illustrates a frequency warped tiling pattern achieved by applying the wrapping curves shown in FIG. 9 to a tiled wavelet transform such as that shown in FIG. 8.

Further embodiments of the invention can yield speech with a musical character by extending the wavelet transform definitions in several directions, for example as illustrated for a single wavelet in FIG. 9, to provide the more complex tiling pattern shown in FIG. 10. In FIG. 10, it will be understood that, initially, as in FIG. 8, the higher frequency time blocks extend vertically, and the lower frequency time blocks extend horizontally. This method can provide the ability to efficiently identify all or many of the frequencies in different time units to enable an estimate to be made of what frequencies are playing in a give time unit.

Figure 11:
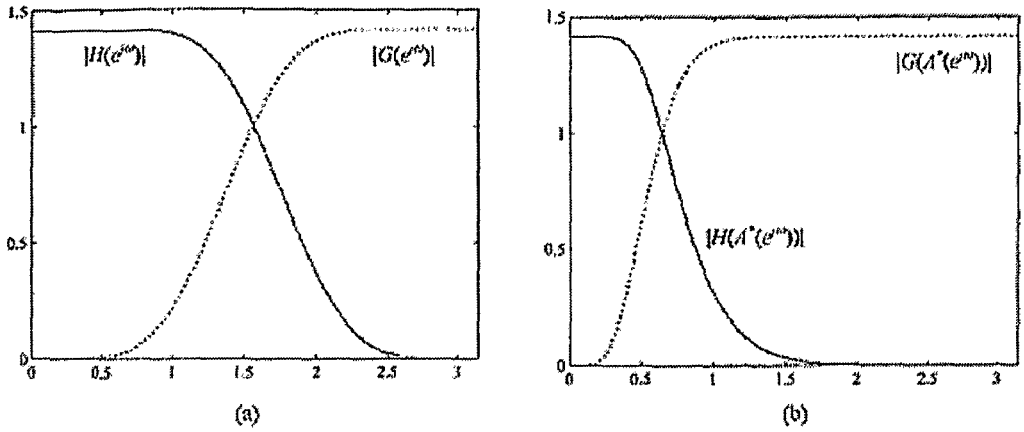
FIG. 11 illustrates two examples of different frequency responses obtainable with different curve wrapping techniques.

In still further embodiments of the invention, the time-frequency tiling can be extended or refined from the embodiment shown in FIG. 8, to provide a wavelet transform that better represents particular elements of the input signal, for example pseudoperiodic elements relating to pitch. If desired, a quadrature mirror filter, as illustrated in FIG. 11, can be employed to provide frequency wrapping, such as is illustrated in FIG. 9. An alternative method of frequency wrapping that may be employed comprises use of a frequency-wrapped filter which may be desirable if the wavelet is implemented using filter banks. The wavelet transform can be further modified or amended in other suitable ways, as will be apparent to those skilled in the art.

FIG. 10 illustrates tiling of a time-frequency plane by means of frequency warped wavelets. A family of wrapping curves such as is shown in FIG. 9 is applied to warp an area of rectangular wavelet tiles configured as shown in FIG. 8 with dimensions related to frequency and time. Again, frequency is plotted on the y-axis against time on the x-axis. Higher frequency tiles with longer y-axis frequency displacements and shorter x-axis time displacements are shown toward the top of the graph. Lower frequency tiles with shorter y-axis frequency displacements and longer x-axis time displacements are shown toward the bottom of the graph.

Wavelet warping by methods such as described above can be helpful in allowing prosody coefficients to be derived for transforming baseline speech to a desired alternative prosody speech in manner whereby the desired transformation can be obtained by simple arithmetical manipulation. For example, changes in pitch, amplitude, and duration can be accomplished by multiplying or dividing the prosody coefficients.

In this way, and others as described herein, the invention provides, for the first time, methods for controlling pitch, amplitude and duration in a concatenated speech synthesizer system. Pitch synchronous wavelet transforms to effect morphological fusion can be accomplished by zero-loss filtering procedures that separate the voiced and unvoiced speech characteristics into multiple different categories, for example, five categories. More or less categories may be employed, if desired, for example from about two to about ten categories. Unvoiced speech characteristics may comprise speech sounds that do not employ the vocal chords, for example glottal stops and aspirations.

In one embodiment of the invention, about five categories, for example are employed for various voice characteristics and to use different music transforms to accommodate various fundamental frequencies of voices such as female high-pitch, male high-pitch, and male or female with unusually low pitches.

FIG. 11 illustrates frequency responses obtainable two different filter systems, namely, (a) quadrature mirror filters and (b) a frequency-warped filter bank There can be several different ways the wavelet transform can be implemented in software. FIG. 11 shows a filter bank implementation of a wavelet transform. As is apparent if suitable parameters are extracted in signal 59, as described with reference to FIG. 14, then this can be used to specifically design a quadrature mirror filter in several ways. Two different such designs are shown in FIGS. 11*a* and *b*.

The invention includes a method of phoneme fusion for smoothly connecting phonemes to provide a pleasing and seamless compound sound. In one useful embodiment of the phoneme fusion process, which can usefully be described as "morphological fusion" the morphologies of the two or more phoneme waveforms to be fused are taken into account and suitable intermediate wave components are provided.

In such morphological fusion, one waveform or shape, representing a first phoneme is smoothly connected or fused, to an adjacent waveform, desirably without, or with only minor, discontinuities, by paying regard to multiple characteristics of each waveform. Desirably also, the resultant compound or linked phonemes may comprise a word, phrase, sentence or the like, which has a coherent integral sound. Some embodiments of the invention utilize a stress pattern, prosody or both stress pattern and prosody instructions to generate intermediate frames. Intermediate frames can be created by morphological fusion, utilizing knowledge of the structure of the two phonemes to be connected and a determination as to the number of intermediate frames to create. The morphological fusion process can create artificial waveforms having suitable intermediate features to provide a seamless transition between phonemes by interpolation between the characteristics of adjacent phonemes or frames.

In one embodiment of the invention, morphological fusion can be effected in a pitch-synchronous manner by measuring pitch points at the end of a wave data sequence and the pitch points at the beginning of the next wave data sequence and then applying fractal mathematics to create a suitable wave morphing pattern to connect the two at an appropriate pitch and amplitude to reduce the probability of the perception of a pronunciation "glitch" by a listener.

The invention includes embodiments where words, partial words, phrases or sentences represented by compound fused phonemes are stored in a database to be retrieved for assembly as elements of continuous or other synthesized speech. The compound phonemes may be stored in the phoneme database, in a separate database or other suitable logical location, as will be apparent to those skilled in the art.

The use of a morphological phoneme fusion process, such as is describe above, to concatenate two phonemes in a speech synthesizer is illustrated in FIGS. 8 and 9, by way of the example of forming the word "have". In light of this example and this disclosure, a skilled worker will be able to similarly fuse other phonemes, as desired.

Figure 12:
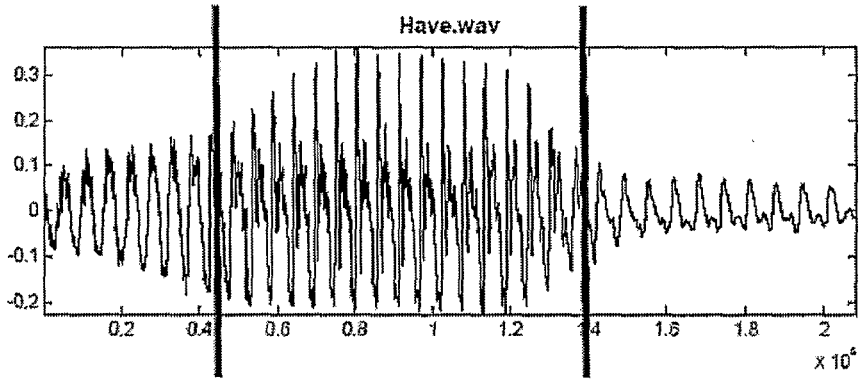
FIG. 12 shows the waveform of a compound phonemic signal representing the single word "have"

As shown in FIG. 12, a compound phoneme signal for the word 'Have' is created by morphological fusion utilizing the phonetic conversion described with reference to FIG. 3, of the three phonemes H, #6 and V. The approximate regions corresponding to the three phonemes have been indicated by two vertical separator lines. However, because the fusion is gradual, it is difficult to identify a single frame as separating one phoneme from another solely by the comparative appearance of adjacent frames.

Figure 13:
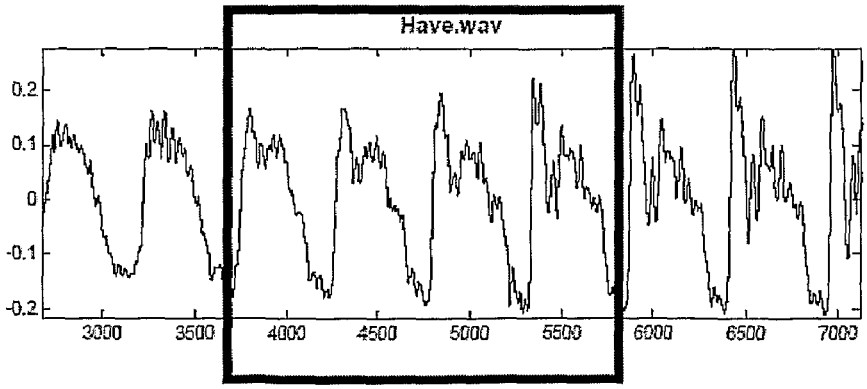
FIG. 13 is an expanded view to a larger scale of a portion of the signal represented in FIG. 12.

In the zoomed view of a portion of FIG. 12 provided in FIG. 13, it can be seen that the four pitch periods within the rectangle are intermediate frames. These intermediate frames provide a gradual progression from the pitch period just before the rectangle, which is an 'H' frame to the pitch period just after the rectangle which is a '#6' frame. The amplitudes of both the highest peaks and the deepest troughs can be seen to be increasing along the x-axis.

The pitch period can be the inverse of a fundamental frequency of a periodic signal. Its value is constant for perfectly periodic signal but for pseudo-periodic signals its value will keep on changing. For example, the pseudo-periodic signal of FIG. 13 has four pitch periods inside the rectangle.

One useful embodiment of the method of morphological fusion of two phones illustrated in FIG. 13 effects phoneme fusion by determining a suitable number of intermediate frames, e.g. four shown, and synthetically generating these frames as progressive steps from one phoneme to the next, using a suitable algorithm. In other words morphological phoneme fusion can be effected by building missing pitch segments using the adjacent past and future pitch frames, and interpolating between them.

Figure 14:
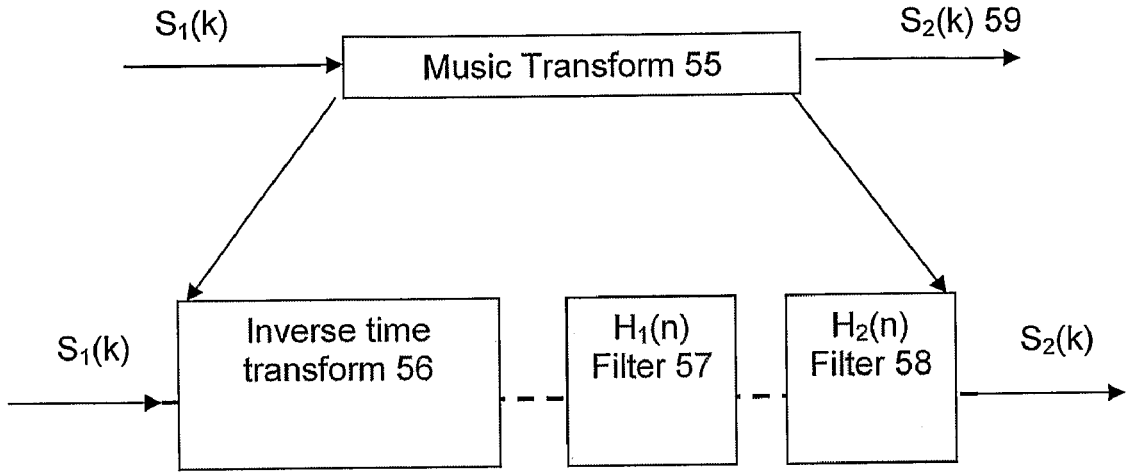
FIG. 14 is a schematic representation of a music transform useful for adding musicality to speech signal utilized in the practice of the invention.

Referring now to FIG. 14, the embodiment of music transform shown comprises a music transform module 55 which transforms an input signal $S_1(k)$ to a more musical output signal S2(*k*). Music transform 55 can comprise an inverse time transform 56, and two digital filters 57 and 58 to add harmonics $H_1(n)$ and $H_2(n)$, respectively. Signal $S_1(k)$ can be a relatively unmusical signal, may comprise an assembled string of phonemes, as described herein, desirably with morphological fusion. Use of music transform 55 can serve to import musicality. Embodiments of the invention can yield a method for acoustic mathematical modeling of the base prosody to convert to a desired alternative prosody. The generated parameters 59 can be stored in differential prosody database 10.

It will be understood that the databases employed can, if desired include features of the databases described in the commonly owned patents and applications for example in Handal et al. U.S. Pat. No. 6,963,841 (granted on application Ser. No. 10/339,370). Thus, the speech synthesizer or speech synthesizing method can include, or be provided with access to, two or more databases selected from the group consisting of: a proper pronunciation dialect database comprising acoustic profiles, prosodic graphemes, and text for identifying correct alternative words and pronunciations of words according to a known dialect of the native language; a database of rules-based dialectic pronunciations according to the Lessac or other recognized system of pronunciation and communication; an alternative proper pronunciation dialect database comprising alternative phonetic sequences for a dialect where the pronunciation of a word is modified because of the word's position in a sequence of words; a pronunciation error database of phonetic sequences, acoustic profiles, prosodic graphemes and text for correctly identifying alternative pronunciations of words according to commonly occurring errors of articulation by native speakers of the language; a Lessac or other recognized pronunciation error database of common mispronunciations according to the Lessac or other recognized system of pronunciation and communication; an individual word mispronunciation database; and a database of common word mispronunciations when speaking a sequence of words. The databases can be stored in a data storage facility component of or associated with the speech synthesis system or method.

A useful embodiment of the invention comprises a novel method of on-demand audio publishing wherein a library or other collection or list of desired online information texts is offered in audio versions either for real-time listening or for downloading in speech files, for example in .WAV files to be played later.

By permitting spoken versions of multiple texts to be automated, or computer-generated the cost of production compared with human speech generation is kept low. This embodiment also includes software for managing an online process wherein a user selects a text to be provided in audio form from a menu or other listing of available texts, a host system locates an electronic file or files of the selected text, delivers the text file or files to a speech synthesis engine, receives a system-generated speech output from the speech synthesis engine and provides the output to the user as one or more audio files provided either as a stream or for download.

With advantage, the speech engine can be a novel speech engine as described herein. Some benefits obtainable employing useful embodiments of the inventive speech synthesizer in an online demand audio publishing system or method include: a small file size enabling broad market acceptance; fast downloads, with or without broadband; good portability attributable to low memory requirements; ability to output multiple voices, prosodies and/or languages, optionally in a common file or files; listener may choose between single or multiple voices, dramatic, reportorial or other reading style; and the ability to vary the speed of the spoken output without substantial pitch variation. A further useful embodiment of the invention employs a proprietary file structure requiring a compatible player enabling a publisher to be protected from bootleg copy attrition Alternatively, a conventional speech engine can be employed, in such an online demand audio publishing system or method, if desired.

The disclosed invention can be implemented using various general purpose or special purpose computer systems, chips, boards, modules or other suitable systems or devices as are available from many vendors. One exemplary such computer system includes an input device such as a keyboard, mouse or screen for receiving input from a user, a display device such as a screen for displaying information to a user, computer readable storage media, dynamic memory into which program instructions and data may be loaded for processing, and one or more processors for performing suitable data processing operations. The storage media may comprise, for example, one or more drives for a hard disk, a floppy disk, a CD-ROM, a tape or other storage media, or flash or stick PROM or RAM memory or the like, for storing text, data, phonemes, speech and software or software tools useful for practicing the invention. The computer system may be a stand-alone personal computer, a workstation, a networked computer or may comprise distributed processing distributed across numerous computing systems, or another suitable arrangement as desired. The files and programs employed in implementing the methods of the invention can be located on the computer system performing the processing or at a remote location.

Software useful for implementing or practicing the invention can be written, created or assembled employing commercially available components, a suitable programming language, for example Microsoft Corporation's C/C++ or the like, Also by way of example, Carnegie Mellon University's FESTIVAL or LINK GRAMAR (trademarks) text parsers can be employed as can applications of natural language processing such as dialog systems, automated kiosk, automated directory services and so on, if desired.

The invention includes embodiments which provide the richness and appeal of a natural human voice with the flexibility and efficiency provided by processing a limited database of small acoustic elements, for example phonemes, facilitated by the novel phoneme splicing techniques disclosed herein that can be performed "on the fly" without significant loss of performance.

Many embodiments of the invention can yield more natural-sounding, or human-like synthesized speech with a preselected or automatically determined prosody. The result may provide an appealing speech output and a pleasing listening experience. The invention can be employed in a wide range of applications where these qualities will be beneficial, as is disclosed. Some examples include audio publishing, audio publishing on demand, handheld devices including games, personal digital assistants, cell phones, video games, pod casting, interactive email, automated kiosks, personal agents, audio newspapers, audio magazines, radio applications, emergency traveler support, and other emergency support functions, as well as customer service. Many other applications will be apparent to those skilled in the art.

While illustrative embodiments of the invention have been described above, it is, of course, understood that many and various modifications will be apparent to those of ordinary skill in the relevant art, or may become apparent as the art develops. Such modifications are contemplated as being within the spirit and scope of the invention or inventions disclosed in this specification.

The invention claimed is:

1. A computerized speech synthesizer for synthesizing prosodic speech from text, the speech synthesizer comprising non-transitory computer-readable storage media, the computer-readable storage media storing software and data that when executed by a computer implements:

a) a text parser to parse text to be synthesized for syntax and meaning, and to identify text elements individually expressible with acoustic phonemes;

b) a prosodic parser to associate prosodic tags with the text elements identified, the prosodic tags indicating pronunciations for the respective text elements to provide desired prosodic characteristics in the output speech;

c) a phoneme database comprising a basic phoneme set, the basic phoneme set including at least about 80 acoustic phonemes useful to express the text elements, each acoustic phoneme having a respective waveform;

d) graphemes to represent the text elements, the graphemes comprising text characters, or symbols representing text characters, wherein each grapheme can be matched with an acoustic phoneme equivalent of the grapheme; and e) a speech synthesis unit to select, sequence, and assemble acoustic phonemes from the phoneme database, the acoustic phonemes being selected to correspond with respective ones of the text elements and their associated prosodic tags, and to generate a prosodic speech signal from the assembled acoustic phonemes as a wave signal;

wherein assembly of the acoustic phonemes includes pitch synchronously connecting one selected acoustic phoneme to the next selected acoustic phoneme, the next selected acoustic phoneme having a significantly different pitch from the pitch of the one selected acoustic phoneme, by generating and interposing one or more artificial waveforms between the one selected acoustic phoneme and the next selected acoustic phoneme to transition the prosodic speech signal from the pitch of the one selected acoustic phoneme to the pitch of the next selected acoustic phoneme.

2. A computerized speech synthesizer according to claim 1 wherein the prosodic tags are associated one with each grapheme and specify desired acoustic values for acoustic phonemes to be selected to express the text elements according to articulatory rules for the text elements.

3. A computerized speech synthesizer according to claim 2 wherein the prosodic tags indicate desired values for pitch, duration and amplitude of each acoustic phoneme.

4. A computerized speech synthesizer according to claim 1, wherein the speech synthesizer comprises acoustic files for producing pronunciations of the parsed text representing audibly different speakers in the text.

5. A computerized speech synthesizer to according to claim 4 wherein the text comprises text appropriate for multiple speakers and the text parser outputs multiple speaker rules that produce natural sounding pronunciations appropriate to the semantic meaning of the parsed text and to the particular persons speaking the parsed text.

6. A computerized speech synthesizer according to claim 1, wherein the text elements can each be selectively expressed by multiple prosodic values to represent the text elements in the prosodic speech signal with a desired one of multiple prosody styles.

7. A computerized speech synthesizer according to claim 6 comprising a differential phoneme database, the differential phoneme database comprising multiple phonetic modification parameters to change the prosody of individual acoustic phonemes in the phoneme database and enable the prosodic speech signal to be audibilized with different prosody styles.

8. A computerized speech synthesizer according to claim 7 wherein the phonetic modification parameters are derived from acoustical recordings of a trained speaker.

9. A computerized speech synthesizer according to claim 1, wherein the interposed one or more artificial wave-forms each have a pitch and an amplitude intermediate between the pitch and amplitude of the one selected acoustic phoneme the pitch and amplitude of the next selected acoustic phoneme.

10. A computerized speech synthesizer according to claim 1, wherein each acoustic phoneme in the basic phoneme set is stored as a wavelet transformation.

11. A computerized speech synthesizer according to claim 1, wherein the number of acoustic phonemes in the phoneme database is from about 100 to about 400.

12. A computerized speech synthesizer according to claim 1, wherein the computerized speech synthesizer comprises acoustic phonemes for producing pronunciations of the parsed text representing different prosody styles.

13. A speech synthesizer according to claim 1, wherein the basic phoneme set has a basic prosody style and the computerized speech synthesizer comprises one or more differential prosody models for application to the basic phoneme set to provide an alternative prosody style in the prosodic speech signal.

14. A computerized speech synthesizer according to claim 1 wherein interpolation of the one or more artificial waveforms is effected by employing an algorithm utilizing fractal mathematics.

15. A computerized speech synthesizer according to claim 1 wherein the speech synthesizer comprises a wave generator to generate the prosodic speech signal from input text, an ambiguity-and-lexical stress module, and a prosodic text analysis component to specify rhythm, intonation and style.

16. A computerized speech synthesizer according to claim 1, wherein the computerized speech synthesizer further comprises a music transform module to transform the prosodic speech signal to a musical output signal.

17. A computerized speech synthesizer according to claim 1, wherein the text parser can effect a text normalization step wherein text to be synthesized is normalized, a part-of-speech tagging step, a syntactic analysis step, a meaning assignment step, and a prosodic context identification step, to generate prosodically parsed text.

18. A computerized speech synthesizer according to claim 1, wherein the text parser can assign prosodic markings by prosodically parsing each text sentence into an array, assigning pronunciation rules to the letters comprising the words in the text sentence, examining the letter sequences across word boundaries to identify pronunciation rules modification, identifying the part-of-speech of each word in the text sentence, assigning an intonation pattern, creating a prosodically marked up text, and outputting the prosodically marked up text to create a grapheme-to-phoneme matrix.

19. An on-demand audio publishing system comprising a computerized speech synthesizer according to claim 1.

20. An on-demand audio publishing system comprising a computerized speech synthesizer according to claim 3 configured to produce speech accessible over a client-server network, the Internet, or a handheld device.

* * * * *